US006821384B1

(12) United States Patent
Seppänen

(10) Patent No.: US 6,821,384 B1
(45) Date of Patent: Nov. 23, 2004

(54) PROCESS FOR THE TREATMENT OF FLY ASH, USING HYDROCHLORIC ACID

(75) Inventor: Reijo Seppänen, Äetsä (FI)

(73) Assignee: Finnish Chemicals Oy, Aetsa (FI)

( * ) Notice: Subject to any disclaimer, the term of this patent is extended or adjusted under 35 U.S.C. 154(b) by 0 days.

(21) Appl. No.: 09/958,326

(22) PCT Filed: Apr. 7, 2000

(86) PCT No.: PCT/FI00/00295

§ 371 (c)(1),
(2), (4) Date: Oct. 9, 2001

(87) PCT Pub. No.: WO00/61859

PCT Pub. Date: Oct. 19, 2000

(30) Foreign Application Priority Data

Apr. 9, 1999 (FI) ..... 990781

(51) Int. Cl.[7] ..... D21C 11/00; D21C 11/04

(52) U.S. Cl. ..... 162/29; 162/30.11; 210/711; 210/723; 210/928

(58) Field of Search ..... 162/29, 30.11; 210/711, 717, 723, 928; 423/499

(56) References Cited

U.S. PATENT DOCUMENTS

| | | | | |
|---|---|---|---|---|
| 3,833,462 A | * | 9/1974 | Moy et al. | 162/29 |
| 4,420,369 A | * | 12/1983 | Eaton et al. | 162/29 |
| 5,919,424 A | | 7/1999 | Klyosov et al. | |

FOREIGN PATENT DOCUMENTS

| | | | |
|---|---|---|---|
| EP | 0 754 799 | * | 1/1997 |
| FR | 2761 088 | * | 9/1998 |
| FR | 2 761 088 | | 9/1998 |
| JP | 960196332 | * | 1/1996 |

* cited by examiner

*Primary Examiner*—Steve Alvo
(74) *Attorney, Agent, or Firm*—Young & Thompson

(57) ABSTRACT

The invention relates to a process for the treatment of fly ash accumulating in the electro-filter of the soda recovery unit in a sulfate cellulose mill, the ash containing primarily Na sulfate, Na chloride, Na carbonate and K sulfate, to produce industrial raw materials, in which process the fly ash is dissolved in water, the carbonate present therein is broken down with hydrochloric acid to Na chloride, a sulfate precipitation chemical in chloride form is added, the sulfate precipitate obtained is separated from the solution, and the chloride-containing solution is recovered.

4 Claims, No Drawings

PROCESS FOR THE TREATMENT OF FLY ASH, USING HYDROCHLORIC ACID

The present invention relates to a process for the treatment of fly ash accumulated in the flue gas filter of the soda recovery unit used for the recovery of chemicals in the manufacture of sulfate cellulose, so as to separate commercially exploitable chemicals therefrom. According to the invention, a process is provided wherein no waste is formed from the fly ash; all of its components are exploited.

BACKGROUND OF THE INVENTION

For reasons of environmental protection, an aim in connection with the manufacture of sulfate cellulose is to attain as complete recovery of chemicals as possible in order to reduce effluent emissions. A soda recovery unit in which the waste liquor it of the cellulose mill is burned is used for the recovery of chemicals. In the flue gas filter of the soda recovery unit there accumulates a very fine-grained fly ash, which is composed of a solid-state salt mixture. The composition of the fly ash is typically:

| | |
|---|---|
| Na sulfate | 74% |
| Na chloride | 3% |
| Na carbonate | 13% |
| K sulfate | 10% |

In other respects the fly ash is rather pure, although it does contain a small amount of water-soluble calcium as an purity. In addition to sulfate, the fly ash contains only carbonate in a significant amount.

There are previously known several processes by which potassium and chloride, which are regarded as detrimental substances in terms of further use, are removed from the fly ash and are thereafter released along with the effluents into water-courses. It is an object of the present invention indeed to recover, in a commercially exploitable form, all of the chemicals accumulating in the fly ash from the chemicals cycle of sulfate cellulose manufacture. It is a particular object of the invention to provide a process for treating the raw material in such a manner that hardly any substance to be considered waste is formed, and that also the remaining chloride-containing solution is so pure that it can be used as a raw material of an electrolysis process, for example, in the production of chlorine alkali or chlorate. According to the invention, this is accomplished in the manner described in the accompanying claims. FR patent application 2 761 088 describes a process for the recovery of sodium sulfate from fly ash formed in connection with the manufacture of sulfate cellulose. In this process, the fly ash is dissolved in water, carbonates are removed from the obtained solution by a sulfuric acid treatment, and the obtained sodium sulfate is separated from the solution by crystallization. In the process according to the French patent application, the remaining solution is in part recycled to the process and in part released into the effluents. By this process, the sodium carbonate present in the fly ash is converted to sodium sulfate, which can be recovered in an almost pure form. However, potassium sulfate and sodium chloride are still left in the unexploitable solution passing into the effluents. In this process, hydrochloric acid cannot be used for breaking down the carbonate, since it would only increase the amount of sodium chloride waste.

However, it is not profitable to crystallize all of the sodium sulfate, since this is technically cumbersome and would therefore be expensive; instead, the mother liquor from the crystallization can be directed to a subsequent purification step, wherein a portion of the remaining sodium sulfate is separated by precipitation. According to the process disclosed in JP patent 960196332, the sulfate is precipitated by adding calcium chloride to the above-mentioned mother liquor, whereupon calcium sulfate (gypsum) which precipitates and can be removed by filtration is obtained as a product.

In the above-mentioned precipitation of gypsum, another product formed is sodium chloride NaCl, which contains as impurities both calcium and sulfate in such amounts that they hamper the use of the formed NaCl as a raw material in electrolysis. Thus, if it is desired to use this NaCl salt as a raw material in electrolysis, it must be purified further.

U.S. Pat. No. 3,833,462 describes a process wherein sodium chloride is separated from fly ash for further exploitation. In this process, the sodium carbonate is converted to sodium sulfate by means of sulfuric acid, and the solid sodium sulfate obtained in the process is separated from a sodium chloride solution. However, the Na chloride solution contains potassium sulfate as an impurity, and thus it cannot be used directly as a raw material in the chemicals industry.

SUMMARY OF THE INVENTION

In the process according to the present invention, the aim is to obtain as high a sodium chloride yield from fly ash as possible. For this purpose, the carbonate present in the fly ash is broken down with hydrochloric acid, whereupon a solution which contains in the main Na chloride and sulfate is obtained as the result. In the process according to the invention, the Na sulfate need not necessarily be crystallized out from the solution; the entire solution can be fed directly to the precipitation step. In this process, a chloride, for example, calcium chloride or barium chloride, is used for the precipitation of the sulfate. The calcium or barium sulfate precipitate obtained by chloride precipitation can be separated by filtration. Thereupon there is left a mother liquor which contains mainly Na chloride.

When sulfate is precipitated with barium chloride in accordance with the invention, Ba sulfate is obtained, which is a useful product and can be used, for example, in medicine as a contrast material in radiography and in the paper industry as a pigment and a filler. Barium sulfate is quite poorly soluble, and thus the mother liquor is rather devoid of sulfate and barium. Thus there is left in the solution, dissolved, Na chloride and a small amount of K chloride. This chloride solution is so pure that it can be used as a raw material, for example, in the preparation of chlorine and chlorate.

In another embodiment of the invention, the sulfate may first be precipitated with calcium chloride, and the calcium sulfate is separated from the solution. The obtained mother liquor still contains as impurities too much calcium and sulfate for the liquor to be used directly as a raw material in the electrolyte industry. The mother liquor has to be purified further by the removal, by barium chloride precipitation, of the sulfate left in the solution. In addition, any excess calcium can be removed from the mother liquor by adding to it a suitable amount of sodium carbonate.

DESCRIPTION OF THE PREFERRED EMBODIMENTS

The invention is described below with the help of examples. The reference example describes a conventional process for the treatment of fly ash and the degree of purity of the NaCl solution obtained by the process. Example 1 presents a process showing how the degree of purity of the NaCl solution can be raised by the precipitation of the sulfate with barium chloride.

REFERENCE EXAMPLE 50 g of fly ash was dissolved in 100 ml of water (pH of the solution 11.4), and 6.3 g of sulfuric acid (96%) was added to the solution for breaking down the Na carbonate. The result obtained was a sulfate which contained some amount of Na chloride. The sulfate was precipitated with calcium chloride, the precipitated gypsum or calcium sulfate was separated, and a mother liquor was obtained which contained:

| | |
|---|---|
| chloride | 4.0% |
| sulfate | 0.45% |
| calcium | 0.16% |

In chlorate electrolysis, the calcium concentration in the cell solution may be at maximum 20 ppm, i.e. 0.002%. Thus, the solution obtained by this process has far too much calcium in proportion to its salt content. A salt solution such as this is not suitable for use as an electrolysis raw material without further purification.

Example 1

The initial material was a similar salt solution prepared from fly ash as in the reference example, and the carbonate was broken down with sulfuric acid. The sulfate was precipitated with a stoichiometric amount of barium chloride, the barium sulfate was separated, and a mother liquor of the following kind was obtained:

| | |
|---|---|
| chloride | 5.26% |
| sulfate | 0.11% |
| barium | 3.3 mg/l, i.e. approximately 0.0003% |

The original fly ash contains as an impurity calcium approximately 10 ppm in a water-soluble form. When such fly ash is dissolved in water to a concentration of 200 g/l, the calcium concentration will be approximately 2 ppm, which is well below the permitted amount. In chlorate electrolysis the permitted barium concentration is 1 ppm, and thus the solution obtained by this process can be used in an amount of one-third of the salt solution feed of a chlorate factory. The K chloride originally present as an impurity in the fly ash is not harmful in the electrolysis.

Example 2

50 g of fly ash was dissolved in 125 ml of water (pH of the solution 11.4), and a 32-percent hydrochloric acid was added to the solution in such an amount that the pH dropped to 2.8, at which all of the Na carbonate had broken down. The consumption of hydrochloric acid was 14.5 g. The result was a solution which contained sulfate 16.42% and chloride 4%.

Example 3

After calcium sulfate precipitation it was desired to decrease the sulfate concentration in the chloride-containing mother liquor. The chloride-containing mother liquor still contained too much sulfate considering its further use in the electrolysis industry. The sulfate concentration of the solution was 0.45%, and its amount was 118.1 g. To this solution, 13.5 g of a barium chloride solution was added. The concentration of the solution was 10% $BaCl_2xH_2O$, i.e. the sulfate was precipitated with a stoichiometric amount of barium. Sulfate precipitate was obtained in an amount of 1.25 g, i.e. the yield was 96.8%. The chloride solution obtained after this treatment was sufficiently pure for use as a raw material in the electrolyte industry.

Example 4

After calcium sulfate precipitation, it was desired to decrease the calcium concentration in the mother liquor, because it was too high for an electrolysis raw material. The calcium concentration of the solution was 0.12%, and its amount was 105.7 g. To this solution, 0.32 g of sodium carbonate, i.e. a 1% excess, was added. After the separation of the formed calcium carbonate precipitate, the mother liquor no longer contained more calcium than 6 ppm, i.e. 0.0006%. The chloride solution obtained after this treatment was sufficiently pure for use as a raw material in the electrolyte industry.

Example 5

70 g of fly ash was dissolved in 200 ml of water, and the insolubles were filtered off. 267.7 g of filtrate was left. 22 g of hydrochloric acid (32%) was added to the filtrate, whereupon the pH of the solution dropped from 11.3 to 1.9. To ensure the removal of the carbon dioxide formed by the breaking down of the carbonate, the solution was boiled. The amount of the solution was 252.8 g, and its chloride concentration was 3.7% and sulfate concentration 14.6%. In order to precipitate the sulfate, 175 g of the solution was taken and 64.0 g of Ba chloride dissolved in 100 ml of water (Ba chloride with 2 crystal water molecules, 96.7%) was added to it. The precipitate was filtered and washed, the washing water was added to the filtrate, and there was obtained a solution in which the Ba concentration was 1 ppm, chloride concentration 7.6%, K concentration 0.7% and sulfate concentration 0.1%. A common salt solution such as this is sufficiently pure for being fed to electrolysis.

What is claimed is:

1. A process for the treatment of fly ash accumulating in the filter of the soda recovery unit in a sulfate cellulose mill, the ash containing primarily Na sulfate, Na chloride, Na carbonate and K sulfate, to produce industrial raw materials, comprising the steps of dissolving the fly ash in water, breaking down the carbonate present therein with hydrochloric acid to Na chloride, adding a sulfate precipitation chemical in chloride form, separating the sulfate precipitate obtained from the solution, and recovering the chloride-containing solution, all in a manner so that all the chemicals from sulfate cellulose manufacture accumulated in the fly ash are substantially recovered, wherein the precipitation chemical is calcium chloride, and after the separation of the calcium sulfate precipitate the mother liquor is purified further by means of barium chloride to remove any excess sulfate.

2. The process according to claim 1, wherein after the separation of the calcium sulfate precipitate the mother liquor is further purified by means of sodium carbonate to remove any excess calcium.

3. The process according to claim 1, wherein a portion of the Na sulfate is separated by crystallization before the adding of the calcium chloride.

4. The process according to claim 1, wherein the recovered chloride solution as such is used as a raw material in an electrolysis process.

* * * * *